US006941709B1

(12) United States Patent
Stanford, Sr.

(10) Patent No.: US 6,941,709 B1
(45) Date of Patent: Sep. 13, 2005

(54) DOOR INSULATOR

(76) Inventor: Denver L. Stanford, Sr., 309 Cardinal La., Clinton, MS (US) 39056

( * ) Notice: Subject to any disclaimer, the term of this patent is extended or adjusted under 35 U.S.C. 154(b) by 0 days.

(21) Appl. No.: 10/647,149

(22) Filed: Aug. 25, 2003

(51) Int. Cl.[7] ..... E05C 7/02; E02D 27/00
(52) U.S. Cl. ..... 52/169.6; 49/62
(58) Field of Search ..... 52/19–21, 169.6, 52/DIG. 12, DIG. 13, 202, 506.01, 506.05, 52/309.8; 160/117, 182, 210, 215; 49/62, 49/501

(56) References Cited

U.S. PATENT DOCUMENTS 1,776,610 A 9/1930 Andrews
2,207,454 A 7/1940 Brierly
4,272,934 A * 6/1981 Cowden et al. ..... 52/202
4,344,505 A * 8/1982 Waters et al. ..... 182/47
4,495,978 A * 1/1985 Carroll ..... 160/117
5,085,022 A 2/1992 Paliwoda
5,428,925 A 7/1995 Snyder
5,600,921 A 2/1997 Vardaro
5,623,795 A 4/1997 Padgett, Jr.

* cited by examiner

*Primary Examiner*—Naoko Slack

(57) ABSTRACT

A door insulator includes a door covering and insulator device for selectively positioning over exterior positioned lower level doors. The lower level doors includes a pair of doors that are positioned on a frame which is angled upwardly from a front wall to a back wall such that the doors lie at an acute angle with respect to a ground surface. The device comprises a first panel and a second panel that each has a size and shape substantially equal to a size and shape of the doors. An inner edge and an outer edge are defined with respect to the first and second panels when the first and second panels are selectively positioned on the doors. Each of the panels comprises an insulating material. A securing member is adapted for selectively attaching the first and second panels together along their respective inner edges.

8 Claims, 3 Drawing Sheets

DOOR INSULATOR

BACKGROUND OF THE INVENTION

1. Field of the Invention

The present invention relates to door insulating devices and more particularly pertains to a new door insulating device for insulating outside doors which provide access to a basement of a dwelling.

2. Description of the Prior Art

The use of door insulating devices is known in the prior art. While these devices fulfill their respective, particular objectives and requirements, the need remains for a device that is retrofittable to existing doors in such a manner that they may be easily positioned on, and removed from, the doors.

SUMMARY OF THE INVENTION

The present invention meets the needs presented above by including panels which are removably positioned on doors without fasteners so that the panels can be retrofitted to the doors without damaging or otherwise compromising the structure of the doors.

Another object of the present invention is to provide a new door insulating device that includes coverings which are positionable around the side walls and front of the frame of the doors.

To this end, the present invention generally comprises a door covering and insulator device for selectively positioning over exterior positioned lower level doors. The lower level doors includes a pair of doors that are positioned on a frame which is angled upwardly from a front wall to a back wall such that the doors lie at an acute angle with respect to a ground surface. The frame has a pair of side walls each having an increasing height from the front wall to the back wall. The device comprises a pair of panels such that a first panel and a second panel are defined. Each of the panels has a size and shape substantially equal to a size and shape of the doors. Each of the first and second panels has an inner surface, an outer surface, an upper edge and a lower edge. Each of the first and second panels is selectively positioned on one of the doors such that the upper and lower edges of the first and second panels are aligned. An inner edge and an outer edge is defined with respect to the first and second panels when the first and second panels are positioned on the doors. Each of the panels comprises an insulating material. A securing member is adapted for selectively attaching the first and second panels together along the inner edges.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
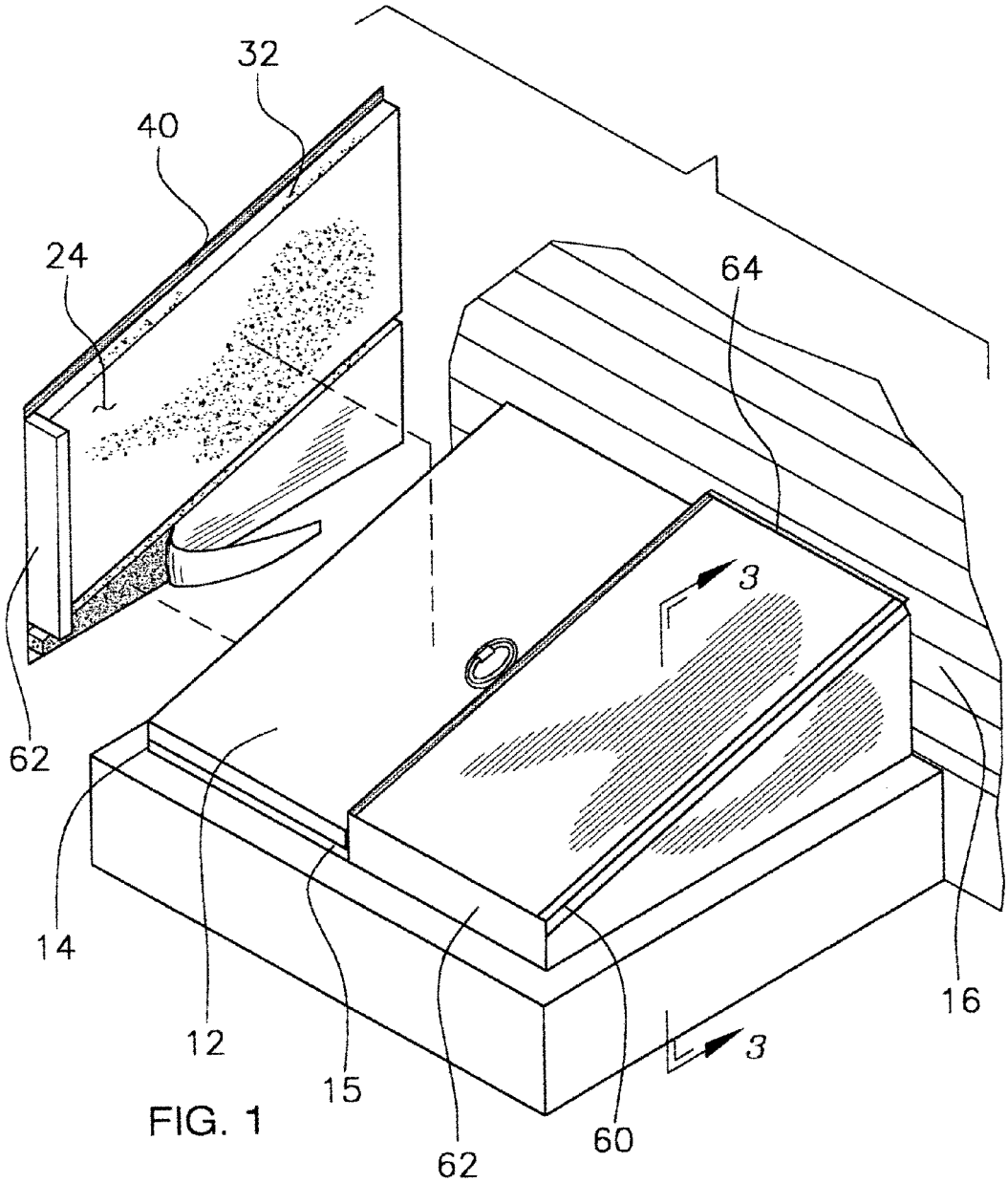
FIG. 1 is a schematic perspective in-use view of a door insulator according to the present invention.
Figure 2:
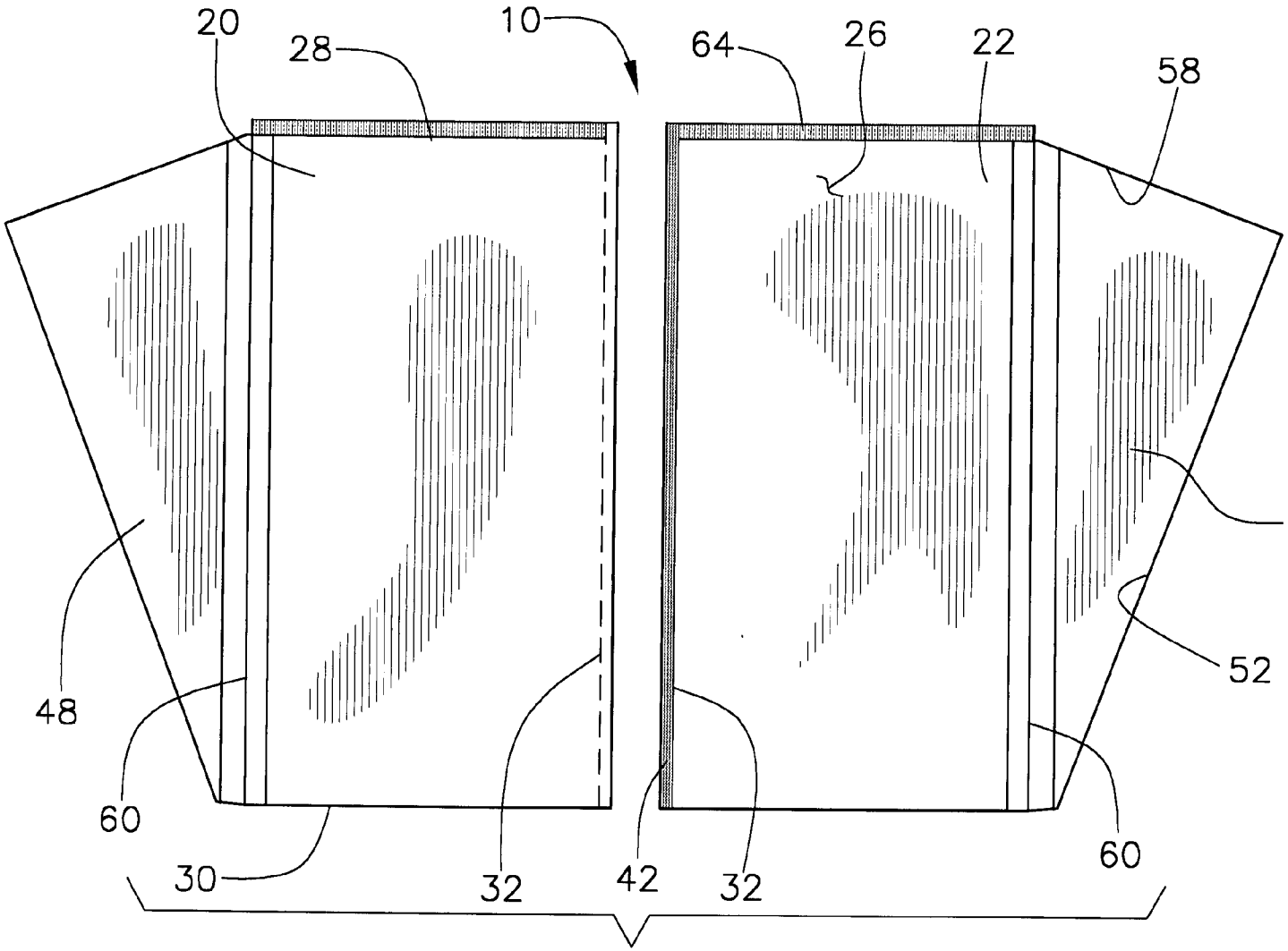
FIG. 2 is a schematic top view of the present invention.

With reference now to the drawings, and in particular to FIGS. 1 through 4 thereof, a new door insulating device embodying the principles and concepts of the present invention and generally designated by the reference numeral 10 will be described.

As best illustrated in FIGS. 1 through 4, the door insulator 10 generally comprises a device which is preferably constructed for selectively positioning over exterior positioned lower level doors 12. Such doors 12 are of the type that are generally used for entering a basement structure of a dwelling from outside of the dwelling. The lower level doors 12 include a pair of doors that are positioned on a conventional frame 14 which is angled upwardly from a front wall 15 to a back wall 16 such that the doors 12 lie at an acute angle with respect to a ground surface. An outer wall of the dwelling generally forms the back wall 16. The frame 14 has a pair of side walls 17 each having an increasing height from the front wall 15 to the back wall 16.

The door insulator 10 comprises a pair of panels such that a first panel 20 and a second panel 22 are defined. Each of the panels 20, 22 has a size and shape substantially equal to a size and shape of the doors 12. The first 20 and second 22 panels each have an inner surface 24, an outer surface 26, an upper edge 28 and a lower edge 30. The first 20 and second 22 panels each is selectively positioned on one of the doors 12 such that the upper 28 and lower 30 edges of the first 20 and second 22 panels are aligned. An inner edge 32 and an outer edge 34 is defined with respect to the first 20 and second 22 panels when the first 20 and second 22 panels are positioned on the doors 12. Each of the panels 20, 22 comprises an insulating material and may include any conventional insulating material that retains its shape and is substantially rigid. This may include a foamed elastomeric material. Preferably, the outer surfaces 26, if not the entirety of the surfaces of the panels 20, 22, are treated with a water and air impermeable material.

Figure 4A:
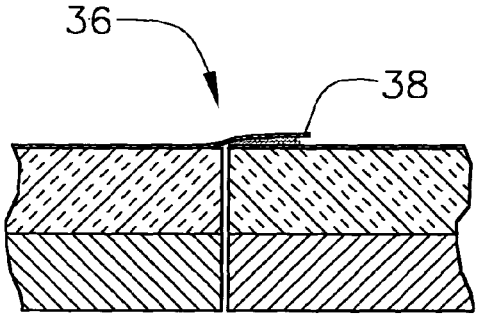
FIG. 4*a* is a schematic cross-sectional view of the securing member of the present invention.
Figure 4B:
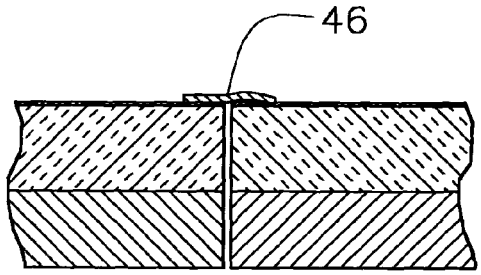
FIG. 4*b* is a schematic cross-sectional view of a second embodiment of the securing member of the present invention.

A securing member 36 is adapted for selectively attaching the first 20 and second 22 panels together along the inner edges 32. The securing member 26 includes a flap 38 that is attached to the outer surface 26 of the first panel 20 and is positioned adjacent to and extending along the inner edge 32 of the first panel 20. The flap 38 extends outwardly away from the inner edge 32 of the first panel 20. A hook and loop securing combination includes a first portion 40 that is attached to and extends along a bottom side of a free portion of the flap 38 and a second portion 42 that is attached to the outer surface 26 of the second panel 22 and positioned adjacent to the inner edge 32 of the second panel 22. The first portion 40 is preferably a hook portion and the second portion 42 a loop portion, though this may be altered. The flap 38 is preferable as it helps to form a better seal between the two panels. Alternatively, conventional mechanical fasteners may be used. FIG. 4*b* depicts a stiffened flap 46 that would simply be positioned over the second panel 22. The stiffened flap 46 would preferably be bent so that it would place pressure downward onto the second panel 22 to form a better seal.

Figure 3:
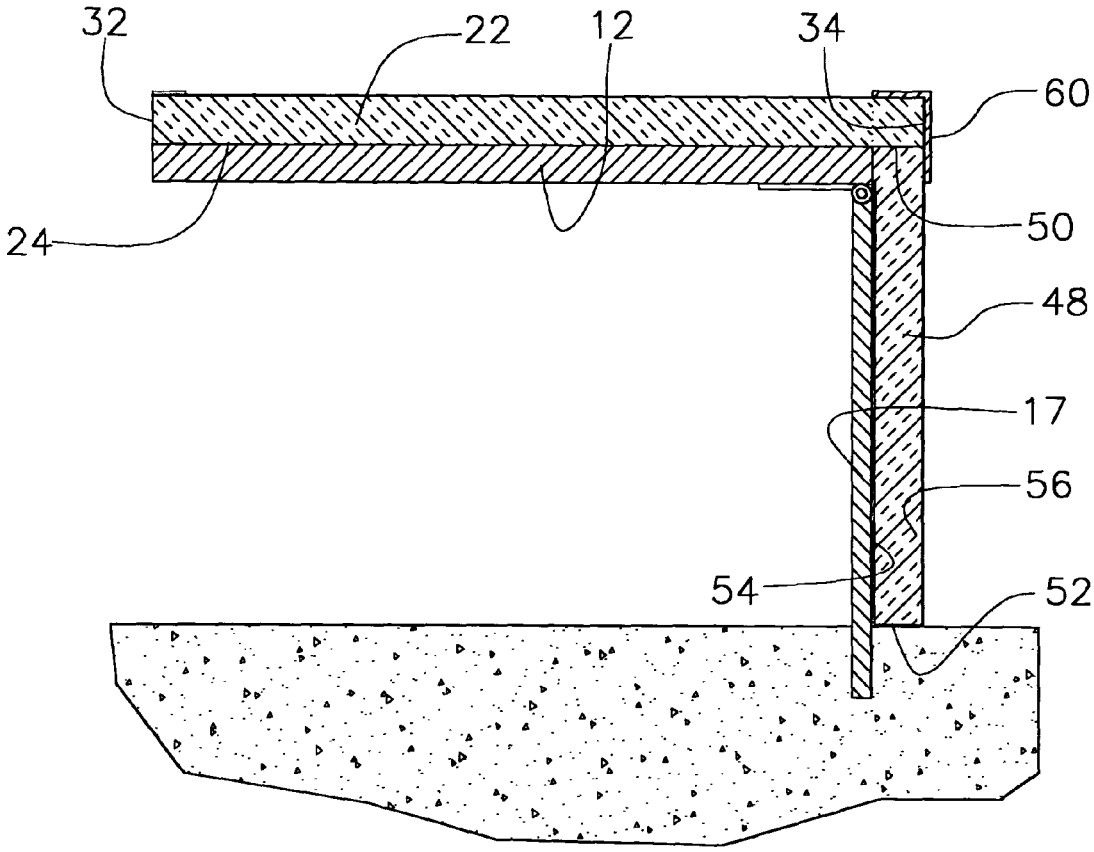
FIG. 3 is a schematic cross-sectional view taken along line 3—3 of FIG. 1 of the present invention.

Each of a pair of side coverings 48 has a size and shape for selectively positioning over and covering one of the side walls 17 of the frame 14. Each of the side coverings 48 includes a top edge 50, a bottom edge 52, an inner surface 54, an outer surface 56, and a rear edge 58. Hinge members 60 hingedly couple each of the side coverings 48 to one of the first 20 and second 22 panels. Each of the side coverings 48 comprises an insulating material. Preferably, the hinge members 60 comprise flexible coverings. Each of the flexible coverings, or hinge members 60, is attached to and extends along one of a pair of junctures of the panels 20, 22 and the side coverings 48. Ideally, the flexible coverings 60 are attached to the outer surfaces 26, 56 of the panels 20, 22 and the side coverings 48 and are preferably comprised of a flexible plastic or elastomeric material. The flexible coverings 60 prevent airflow between the side coverings and the panel. In the most preferred embodiment, the top edges 50 of the side coverings 48 abut the inner surfaces 24 of the panels 20, 22 when the device is in a closed position as shown in FIG. 3.

Each of a pair of end walls 62 is attached to one of the lower edges 30 of the panels 20, 22. When the panels 20, 22 are positioned on the doors 12, the end walls extend downward over the front walls 15 of the frame 14 so that the juncture of the doors 12 and the frame 14 is covered. The end walls 62 may also be constructed of insulating material.

Ideally, a plurality of flexible skirts 64 is attached to the upper edges 28 of the panels 20, 22 for the purpose of preventing air-flow around those edges. Each of the skirts 64 is elongated and preferably comprises an elastomeric material. The skirts 64 are attached to and extend along the upper edges 28 of the panels 20, 22.

In use, the door insulator 10 is positioned over the doors 12 and the panels 20, 22 attached together so that the panels cover the door. The side coverings 48 and end walls 62 cover the other open sides of the frame 14. Once in place, the door insulator 10 provides the doors 12 with protection from the elements and will substantially reduce airflow into the dwelling 16 through the doors 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A door covering and insulator device for selectively positioning over exterior positioned lower level doors, the lower level doors including a pair of doors being positioned on a frame being angled upwardly from a front wall to a back wall such that the doors lie at an acute angle with respect to a ground surface, the frame having a pair of side walls having an increasing height from the front wall to the back wall, said device comprising:

a pair of panels such that a first panel and a second panel are defined, each of said panels having a size and shape substantially equal to a size and shape of the doors, each of said first and second panels having an inner surface, an outer surface, an upper edge and a lower edge, each of said first and second panels being selectively positioned on one of the doors such that said upper and lower edges of said first and second panels are aligned, an inner edge and an outer edge being defined with respect to said first and second panels when said first and second panels are positioned on the doors, each of said panels comprising an insulating material;

a pair of side coverings, each of said side coverings having a size and shape for selectively positioning over and covering one of the side walls of the frame, each of said side coverings including a top edge, a bottom edge, an inner surface, an outer surface, and a rear edge, each of said side coverings being hingedly coupled to one of said first and second panels by hinge members, each of said side coverings comprising an insulating material, said hinge members including a pair of flexible coverings, each of said flexible coverings being attached to and extending along one of a pair of junctures of said panels and said side coverings, said flexible coverings being attached to said outer surfaces of said panels and said side coverings; and a flap being attached to said outer surface of said first panel and being positioned adjacent to and extending along said inner edge of said first panel, said flap extending outwardly away from said inner edge of said first panel, said flap being extendable over said inner edge of said second panel.

2. The door covering and insulator device of claim 1, wherein said securing member further includes a hook and loop securing combination including a first portion being attached to and extending along a bottom side of a free portion of said flap and a second portion being attached to said outer surface of said second panel and positioned adjacent to said inner edge of said second panel.

3. The door covering and insulator device of claim 1, further including a pair of end walls, each of said end walls being attached to one of said lower edges of said pair of panels.

4. The door covering and insulator device of claim 1, further including a pair of end walls, each of said end walls being attached to one of said lower edges of said pair of panels.

5. The door covering and insulator device of claim 1, further including a plurality of flexible skirts, each of said skirts being elongated, each of said skirts being attached to and extending along one of said upper edges of said pair of panels.

6. The door covering and insulator device of claim 5, wherein each of said flexible skirts comprises an elastomeric material.

7. A door covering and insulator device for selectively positioning over exterior positioned lower level doors, the lower level doors including a pair of doors being positioned on a frame being angled upwardly from a front wall to a back wall such that the doors lie at an acute angle with respect to a ground surface, the frame having a pair of side walls having an increasing height from the front wall to the back wall, said device comprising:

a pair of panels such that a first panel and a second panel are defined, each of said panels having a size and shape substantially equal to a size and shape of the doors, each of said first and second panels having an inner surface, an outer surface, an upper edge and a lower edge, each of said first and second panels being selectively positioned on one of the doors such that said upper and lower edges of said first and second panels are aligned, an inner edge and an outer edge being defined with respect to said first and second panels when said first and second panels are positioned on the doors, each of said panels comprising an insulating material;

a securing member being adapted for selectively attaching said first and second panels together along said inner edges, said securing member including a flap being attached to said outer surface of said first panel and being positioned adjacent to and extending along said inner edge of said first panel, said flap extending outwardly away from said inner edge of said first panel, a hook and loop securing combination including a first portion being attached to and extending along a bottom side of a free portion of said flap and a second portion being attached to said outer surface of said second panel and positioned adjacent to said inner edge of said second panel;

a pair of side coverings, each of said side coverings having a size and shape for selectively positioning over and covering one of the side walls of the frame, each of said side coverings including a top edge, a bottom edge, an inner surface, an outer surface, and a rear edge, each of said side coverings being hingedly coupled to one of said first and second panels by hinge members, each of said side coverings comprising an insulating material, said hinge members comprising a pair of flexible coverings, each of said flexible coverings being attached to and extending along one of a pair of junctures of said panels and said side coverings, said flexible coverings being attached to said outer surfaces of said panels and said side coverings;

a pair of end walls, each of said flaps being attached to one of said lower edges of said panels; and a plurality of flexible skirts, each of said skirts being elongated, each of said skirts being attached to and extending along one of said upper edges of said panels, each of said flexible skirts comprising an elastomeric material.

8. A door covering and insulator device for selectively positioning over exterior positioned lower level doors, the lower level doors including a pair of doors being positioned on a frame being angled upwardly from a front wall to a back wall such that the doors lie at an acute angle with respect to a ground surface, the frame having a pair of side walls having an increasing height from the front wall to the back wall, said device comprising:

a pair of panels such that a first panel and a second panel are defined, each of said panels having a size and shape substantially equal to a size and shape of the doors, each of said first and second panels having an inner surface, an outer surface, an upper edge and a lower edge, each of said first and second panels being selectively positioned on one of the doors such that said upper and lower edges of said first and second panels are aligned, an inner edge and an outer edge being defined with respect to said first and second panels when said first and second panels are positioned on the doors, each of said panels comprising an insulating material;

a pair of end walls, each of said end walls being attached to one of said lower edges of said pair of panels; and a stiffened flap being attached to said outer surface of said first panel and being positioned adjacent to and extending along said inner edge of said first panel, said stiffened flap extending outwardly away from said inner edge of said first panel, said stiffened flap being extendable over said inner edge of said second panel.

* * * * *